US007775166B2

(12) United States Patent
Aradi et al.

(10) Patent No.: US 7,775,166 B2
(45) Date of Patent: Aug. 17, 2010

(54) METHOD OF USING NANOALLOY ADDITIVES TO REDUCE PLUME OPACITY, SLAGGING, FOULING, CORROSION AND EMISSIONS

(75) Inventors: Allen A. Aradi, Glen Allen, VA (US); Joseph W. Roos, Mechanicsville, VA (US); Michael W. Meffert, Chesterfield, VA (US)

(73) Assignee: Afton Chemical Corporation, Richmond, VA (US)

( * ) Notice: Subject to any disclaimer, the term of this patent is extended or adjusted under 35 U.S.C. 154(b) by 393 days.

(21) Appl. No.: 11/687,299

(22) Filed: Mar. 16, 2007

(65) Prior Publication Data

US 2008/0223270 A1 Sep. 18, 2008

(51) Int. Cl.
*F23B 7/00* (2006.01)
*B01D 53/34* (2006.01)

(52) U.S. Cl. ..... 110/345; 110/342; 110/343; 110/344; 44/252; 44/603

(58) Field of Classification Search ..... 110/342–345; 44/252, 603
See application file for complete search history.

(56) References Cited

U.S. PATENT DOCUMENTS

| | | | | |
|---|---|---|---|---|
| 5,740,745 | A * | 4/1998 | Smyrniotis et al. | 110/343 |
| 5,894,806 | A | 4/1999 | Smyrniotis et al. | |
| 6,136,048 | A | 10/2000 | Birchem et al. | |
| 6,138,048 | A * | 10/2000 | Hayner | 700/31 |
| 6,206,685 | B1 * | 3/2001 | Zamansky et al. | 431/4 |
| 6,432,320 | B1 * | 8/2002 | Bonsignore et al. | 252/70 |
| 7,162,960 | B2 | 1/2007 | Smyrniotis et al. | |
| 2005/0066571 | A1 | 3/2005 | Wakefield | |
| 2006/0110279 | A1 * | 5/2006 | Han et al. | 420/523 |
| 2007/1080760 | | 8/2007 | Zhou et al. | |

FOREIGN PATENT DOCUMENTS

| | | | |
|---|---|---|---|
| WO | WO 97/44414 | * | 11/1997 |
| WO | WO 9744414 | | 11/1997 |
| WO | WO 0200812 | | 1/2002 |
| WO | WO 2004/065529 | | 8/2004 |

OTHER PUBLICATIONS

USPTO Office Action, U.S. Appl. No. 11/465,160, mailing date May 26, 2009.
Canadian Office Action, Serial No. 2/617,421; date mailed Oct. 26, 2009; 2 pages.

* cited by examiner

*Primary Examiner*—Steven B McAllister
*Assistant Examiner*—Nikhil Mashruwala
(74) *Attorney, Agent, or Firm*—Thomas, Karceski, Raring & Teague, P.C.

(57) ABSTRACT

A process for improving the operation of combustors includes the steps of burning a carbonaceous fuel in a combustor system and determining combustion conditions within the combustor system that can benefit from a targeted treatment additive, wherein the determinations are made by calculation including computational fluid dynamics and observation. The process further includes locating introduction points in the combustor system where introduction of the targeted treatment additive could be accomplished. Based on the previous steps, a treatment regimen for introducing the targeted treatment additive to locations within the combustor system results in one or more benefits selected from the group consisting of reducing the opacity of plume, improving combustion, reducing slag, reducing LOI and/or unburned carbon, reducing corrosion, and improving electrostatic precipitator performance. The targeted treatment additive comprises an alloy represented by the following generic formula $(A_a)_n (B_b)_n (C_c)_n (D_d)_n(\ldots)_n$, wherein each capital letter and (. . .) is a metal, wherein A is a combustion modifier, B is a deposit modifier; C is a corrosion inhibitor; and D is a combustion co-modifier/electrostatic precipitator enhancer, wherein each subscript letter represents compositional stoichiometry, wherein n is greater than or equal to zero and the sum of n's is greater than zero, and wherein the alloy comprises at least two different metals, with the proviso that if the metal is cerium, then its compositional stoichiometry is less than about 0.7.

30 Claims, No Drawings

METHOD OF USING NANOALLOY ADDITIVES TO REDUCE PLUME OPACITY, SLAGGING, FOULING, CORROSION AND EMISSIONS

The invention relates to a process for reducing the opacity of plume released to the atmosphere from large-scale combustors, such as the type used industrially and by utilities to provide power and incinerate waste. According to the invention, plume opacity is mitigated, as well as improving combustion and/or reducing slag and/or reducing LOI and/or unburned carbon and/or reducing corrosion and/or improving electrostatic precipitator performance. The invention achieves one or more of these desired results through the use of a targeted treatment additive introduced into the combustor system.

BACKGROUND

The combustion of carbonaceous fuels, such as heavy fuel oils, coals, refinery coke, and municipal and industrial waste, typically produces a plume arising from the smoke stack and can have opacity ranging from low to high. In addition, combustion of these fuels can result in the formation of slag, corrosive acids and highly carbonaceous particulate matter that alone or in combination can have a relatively negative effect on the productivity of the boilers and present a range of health and environmental risks.

The art has endeavored to solve slagging and/or corrosion problems by introducing various chemicals into the combustion system, such as magnesium oxide or hydroxide. Magnesium hydroxide has the ability to survive the hot environment of the furnace and react with the deposit-forming compounds, increasing the ash fusion temperature and/or modifying the texture of the resulting deposits. Unfortunately, the introduction of the chemicals has been very expensive due to poor utilization of the chemicals, much simply going to waste and some reacting with hot ash that would not otherwise cause a problem. U.S. Pat. Nos. 5,740,745, 5,894,806, and 7,162,960 deal with this problem, by introducing chemicals in one or more stages to directly address predicted or observed slagging and/or corrosion.

Metal-containing fuel additives are known in many forms, from homogeneous solutions in aqueous or hydrocarbon carrier media, or heterogeneous particle clusters extending all the way to visible particles formulated in the slurry form. In between is the nanoparticle range commonly defined to be metal particles above cluster size but below 100 nanometer size range. In all known instances where these metal-containing additives are used, they are introduced to the fuel/combustion/flue gas systems as single, metal-containing additive formulations or as mixtures of different metals The current use of metals in combustion systems relies on chemistries fostered by each metal type as dictated by its unique orbital and electronic configuration acting individually. This means that in additives formulated with metal mixtures, at the time of the intended activity the metals act independently from one another during fuel combustion. In fact the physics of a combusting charge minimizes the likelihood that a mixed metal additive will land the different metal atoms within the same and/or desired and/or proper and/or preferred location on the combusting fuel species so that they may act in unison as a single entity.

The physical form of metal-containing additives of most recent interest is the nanoparticle form because of its unique surface to volume ratios and active site numbers and shapes.

As is to be expected, there is interest in mixed metal nanoadditves because each metal tends to have specific functions.

Combustion systems burning hydrocarbonaceous fuels experience various degrees of combustion inefficiencies due to fuel properties, system design, air/fuel ratios, residence time of fuel/air charge in the combustion zone, and fuel/air mixing rates. These factors lead to imperfect combustion Fuel-side solutions to these problems usually involved some sort of "clean fuel" selection based upon previously determined criteria, or simply the use of additives.

SUMMARY

It is an object of the present invention to improve the operation of combustion systems through the use of metal alloy additives.

In one example, a process for improving the operation of combustors comprises the steps of burning a carbonaceous fuel in a combustor system and determining combustion conditions within the combustor system that can benefit from a targeted treatment additive. The determinations are made by calculation including computational fluid dynamics and observation The process further includes locating introduction points in the combustor system where introduction of the targeted treatment additive could be accomplished. Based on the foregoing steps, the process further includes providing a treatment regiment for introducing the targeted treatment additive to locations within the combustor system resulting in one or more benefits selected from the group consisting of reducing the opacity of plume, improving combustion, reducing slag, reducing LOI and unburned carbon, reducing corrosion, and improving electrostatic precipitator performance The targeted treatment additive comprises an alloy that is comprised of at least two different metals.

DETAILED DESCRIPTION

The invention relates to a process for reducing plume, as well as improving combustion and/or reducing slag and/or corrosion in large-scale combustors, such as of the type used industrially and by utilities to provide power and incinerate waste. The following description will illustrate the invention with reference to a power plant type boiler fired with heavy (e.g., No. 6) fuel oil. It will be understood however, that any other combustor fueled with any other carbonaceous fuel and susceptible to the problems treated by the invention could benefit from the invention. Without meaning to be limiting of the type of fuel, carbonaceous materials such as fuel oil, gas, coal, waste, including municipal and industrial, sludge, and the like, can be employed.

In general, the combustion of carbonaceous fuels, such as heavy fuel oils, coal and municipal and industrial waste, result in effluents having significant plume opacity and can cause slag formation, corrosive acids, that individually and in combination have relatively negative effects on the productivity and social acceptability of the boilers. The invention addresses these problems in a manner that is economically attractive and surprising in effectiveness. The invention provides an improved process for improving the operation of combustors. Important to the process is the determination of combustion conditions within a combustor that can affect plume. The invention can be used to treat plume alone or in conjunction with one or more of high LOI or unburned carbon, slagging and corrosion in the absence of treatment The process will entail combusting a carbonaceous fuel with or without a combustion catalyst and introducing a targeted treatment additive directed at problem areas or to locations where the additive can do the most good. This latter step will require locating introduction points in a combustor system, including on a furnace wall, where introduction of additives to control plume could be accomplished. The invention, thus, can be facilitated by the use of computational fluid dynamics and modeling or observation according to the teachings of U.S. Pat. Nos. 5,740,745, 5,894,806, and 7,162,960. In addition to the specifically identified techniques, those skilled in the art will be able to define other techniques effective for locating the problem areas and, from them, determining the best locations to introduce chemical. The teachings of these patents will not be repeated here, but are incorporated by reference in their entireties to explain suitable techniques effective for the invention.

The present invention is directed to combustor systems generally. Combustor systems can have multiple sections including, in very general terms, a furnace and an emissions aftertreatment system. The furnace will typically include a combustion chamber and heat exchange system. An emissions aftertreatment system may include a reduction catalyst and/or an electrostatic precipitator and/or other emissions control components.

Targeted injection of a treatment additive will require locating introduction points in the combustor system where introduction of the targeted treatment additive could be accomplished. And, based on the determinations of this procedure, a targeted treatment additive is introduced, such as in the form of a spray. The droplets are desirably in an effective range of sizes traveling at suitable velocities and directions to be effective as can be determined by those skilled in the art. These drops interact with the flue gas and evaporate at a rate dependent on their size and trajectory and the temperatures along the trajectory Proper spray patterns result in highly efficient chemical distributions.

As described in the above-identified patents, a frequently used spray model is the PSI-Cell model for droplet evaporation and motion, which is convenient for iterative CFD solutions of steady state processes. The PSI-Cell method uses the gas properties from the fluid dynamics calculations to predict droplet trajectories and evaporation rates from mass, momentum, and energy balances. The momentum, heat, and mass changes of the droplets are then included as source terms for the next iteration of the fluid dynamics calculations, hence after enough iterations both the fluid properties and the droplet trajectories converge to a steady solution. Sprays are treated as a series of individual droplets having different initial velocities and droplet sizes emanating from a central point.

Correlations between droplet trajectory angle and the size or mass flow distribution are included, and the droplet frequency is determined from the droplet size and mass flow rate at each angle. For the purposes of this invention, the model should further predict multi component droplet behavior. The equations for the force, mass, and energy balances are supplemented with flash calculations, providing the instantaneous velocity, droplet size, temperature, and chemical composition over the lifetime of the droplet. The momentum, mass, and energy contributions of atomizing fluid are also included. The correlations for droplet size, spray angle, mass flow droplet size distributions, and droplet velocities are found from laboratory measurements using laser light scattering and the Doppler techniques. Characteristics for many types of nozzles under various operating conditions have been determined and are used to prescribe parameters for the CFD model calculations. When operated optimally, chemical efficiency is increased and the chances for impingement of droplets directly onto heat exchange and other equipment surfaces is greatly reduced. Average droplet sizes within the range of from 20 to 1000 microns are typical, and most typically fall within the range of from about 100 to 600 microns.

One preferred arrangement of injectors for introducing active additives for reducing slag employ multiple levels of injection to best optimize the spray pattern and assure targeting the additive to the point that it is needed. However, the invention can be carried out with a single zone, e.g., in the upper furnace, where conditions permit or physical limitations dictate. Typically, however, it is preferred to employ multiple stages, or use an additive in the fuel and the same or different one in the upper furnace. This permits both the injection of different compositions simultaneously or the introduction of compositions at different locations or with different injectors to follow the temperature variations which follow changes in load.

The total amount of the treatment additive introduced into the combustion gases from all points should be sufficient to obtain a reduction in plume opacity and/or corrosion and/or the rate of slag build-up and/or the frequency of clean-up and/or improving the efficiency of an electrostatic precipitator. The buildup of slag and/or fouling results in increased pressure drop through and poorer heat transfer in the furnace and/or convective pass sections of the boiler (e.g., through the generating bank). Dosing rates can be varied to achieve long-term control of the noted parameters or at higher rates to reduce slag deposits already in place.

It is a distinct advantage of the invention that plume can be well controlled at the same time as corrosion, slag, LOI, unburned carbon, and/or SO.sub.3. The net effect in many cases is a synergy in operation that saves money and/or increases efficiency in terms of lower stack temperatures, cleaner air heater surfaces, lower corrosion rates in the air heaters and ducts, lower excess O.sub.2, cleaner water walls, resulting in lower furnace exit temperatures and cleaner heat transfer surfaces in the convection sections of the boiler.

The process of the invention can be looked at from the unique perspective of system analysis. According to an aspect of the invention directed to an in-furnace treatment, the effectiveness of targeted in furnace injection, in fuel introduction and in furnace introduction of slag and/or corrosion and/or plume control chemicals are determined, as are the effectiveness of targeted in furnace injection, in fuel introduction and in furnace introduction of combustion catalysts. Then, the effectiveness of various combinations of the above treatments are determined, and a treatment regimen employing one or more of the above treatments is selected. Preferred treatment regimens will contain at least two and preferably three of the treatments. In each case, a determination can be any evaluation whether or not assisted by computer or the techniques of the above-referenced patents. In addition, it may involve direct or remote observation during operation or down times. The key factor here and a departure from the prior art is that targeted injection is evaluated along with nontargeted introduction, especially of a combination of combustion catalysts and slagging and/or corrosion and/or plume control chemicals. Chemical utilization and boiler maintenance can improved as LOI, unburned carbon, slagging and/or corrosion are also controlled.

The present disclosure relates in one embodiment to a targeted treatment additive composition comprising an alloy of two or more metals. The additive composition can be provided to a fuel composition. The additive composition may be injected otherwise into a combustor system. As described herein, the alloy is different chemically from any of its constituent metals because it shows a different spectrum in the XRD than that of the individual constituent metals. In other words, it is not a mixture of different metals, but rather, an alloy of the constituent metals used.

The primary determining factors for active metals in combustors to effect system efficiency, emissions, deposit/slag/fouling, and corrosion is primarily the type, shape, size, electronic configuration, and energy levels of lowest unoccupied molecular orbitals (LUMO) and highest occupied molecular orbitals (HOMO) made available by the metal to interact with those of the intended substrate species at the conditions when these species are to be chemically and physically transformed. These LUMO/HOMO electronic configurations are unique to every metal, hence the innate physics/chemistry uniqueness observed between, for example, Mn and Pt, or Mn and Al, etc. For example, these orbital/electronic configurations are key to the redox behavior of these elements, and rehybridizing them by alloying fine tunes this characteristic.

The disclosed alloy is the result of combining the different constituent metal atoms in the compound. This means that the LUMO/HOMO orbitals of the alloy are hybrids of those characteristic of the respective different metal atoms. Therefore, an alloy, for use in a fuel additive composition, ensures that all constituent metals in the alloy particle end up at the same site of the combusting fuel species and act as one, but in the modified i.e., alloy form. The advantages of an alloy for this purpose would be due to unique modifications imparted to the LUMO/HOMO electronic and orbital configurations of the particles by the mixing of LUMO/HOMO orbitals of the different respective alloy composite metals. The number and shape of active sites would be expected to also change significantly in the alloy composites relative to the number and shape of active sites in equivalent but non-alloy mixtures This unique orbital and electronic mixing at the LUMO/HOMO orbital level in the alloys is not possible by simply mixing particles of the respective metals in appropriate functional ratios. This disclosure is directed to alloys present in compositions for multifunctional applications in, for example, beneficial combustion, emissions, and deposits modifications.

Disclosed herein is a composition comprising an alloy represented by the following generic formula $(A_a)_n(B_b)_n(C_c)_n(D_d)_n(\ldots)_n$; wherein each capital letter and (. . .) is a metal, wherein A is a combustion modifier B is a deposit modifier, C is a corrosion inhibitor; and D is a combustion co-modifier/electrostatic precipitator (ESP) enhancer; wherein each subscript letter represents compositional stoichiometry; wherein n is greater than or equal to zero and the sum of n's is greater than zero, and wherein the alloy comprises at least two different metals; and with the proviso that if the metal is cerium, then its compositional stoichiometry is less than about 0.7. In an aspect, the (. . .) is understood to include the presence of at least one metal other than those defined by A, B, C and D and the respective compositional stoichiometry.

Each capital letter in the above-disclosed formula can be a metal. The metal can be selected from the group consisting of metalloids, transition metals, and metal ions. In an aspect, each capital letter can be the same or different. As an example, both B and C can be magnesium (Mg).

Sources of the metal can include, but are not limited to, their aqueous salts, carbonyls, oxides, organometallics, and zerovalent metal powders. The aqueous salts can comprise, for example, hydroxides, nitrates, acetates, halides, phosphates, phosphonates, phosphites, carboxylates, and carbonates.

As disclosed above, A can be a combustion modifier In an aspect, A is a metal selected from the group consisting of Mn, Fe, Co, Cu, Ca, Rh, Pd, Pt, Ru, Ir, Ag, Au, and Ce.

As disclosed above, B can be a deposit modifier. In an aspect, B is a metal selected from the group consisting of Mg, Al, Si, Sc, Ti, Zn, Sr, Y, Zr, Mo, In, Sn, Ba, La, Hf, Ta, W, Re, Yb, Lu, Cu and Ce.

As disclosed above, C can be a corrosion inhibitor. In an aspect, C is a metal selected from the group consisting of Mg, Ca, Sr, Ba, Mn, Cu, Zn, and Cr.

As disclosed above, D can be a combustion co-modifier/electrostatic precipitator (ESP) enhancer. In an aspect, D is a metal selected from the group consisting of Li, Na, K, Rb, Cs, and Mn.

In a further aspect, A, B, and/or D can be an emissions modifier, wherein the metals for each group are disclosed above.

The subscript letters of the disclosed formula represent compositional stoichiometries. For example, for an $A_aB_b$ alloy, such as $Fe_{0.80}Ce_{0.20}$ disclosed herein, a=0.80 and b=0.20. In an aspect, if the metal in the disclosed alloy is cerium (Ce) then its compositional stoichiometry is less than about 0.7, for example less than about 0.5, and as a further example less than about 0.3.

In an aspect, the disclosed alloy can be a nanoalloy. The nanoalloy can have an average particle size of from about 1 to about 100 nanometers, for example, from about 5 to about 75 nanometers, and as a further example from about 10 to about 35 nanometers.

The alloy can be monofunctional such that it can perform any one of the following functions, for example combustion modifier (Group A metal), deposit modifier (Group B metal), corrosion inhibitor (Group C metal), or combustion co-modifier/electrostatic precipitator enhancement (ESP) (Group D metal).

The alloy can also be bifunctional such that it can perform any two of the functions identified above. In an aspect, the alloy can be trifunctional (i.e., it can perform any three of the functions identified above), tetrafunctional (i.e., it can perform any four of the functions identified above); or polyfunctional (i.e., it can perform any number of the functions identified above as well as those that are undefined).

In an aspect, the disclosed alloy can comprise a metal that can be polyfunctional i.e., it is able to perform at least two functions, such as those identified above. For example, as disclosed below, magnesium can function as a deposit modifier (Group B metal) and as a corrosion inhibitor (Group C metal). As a further example, an alloy comprising $Cu_{10}Mg_{90}$ would be a bimetallic alloy that is polyfunctional because the copper can function as a combustion modifier, a deposit modifier, and as a corrosion inhibitor and the magnesium can function as both a deposit modifier and a corrosion inhibitor.

In an aspect, the alloy can be a nanoalloy and can be bimetallic (i.e., any combination of two different metals from the same or different functional groups, e.g., $A_aB_b$, or $A_aA'_{a'}$); trimetallic (i.e., any combination of three different metals from the same or different functional groups, e.g., $A_aB_bC_{c1}$, or $A_aA'_{a'}A''_{a''}$ or $A_aA'_{a'}B_b$); tetrametallic (i.e., any combination of four different metals from the same or different functional groups, e.g., $A_aB_bC_cD_d$ or $A_aA'_{a'}A''_{a'}A'''_{a'''}$ or $A_aB_bB'_{b'}C_c$); or polymetallic (i.e., any combination of two or more metals from the same or different functional groups, e.g., $A_aB_bC_cD_dE_e$. . .etc. or $A_aB_bB'_{b'}C_cD_dD'_{d'}E_e$). The alloy must comprise at least two different metals, but beyond two the number of metals in each alloy would be dictated by the requirements of each specific combustion system and/or exhaust after treatment system.

In an aspect, the composition can comprise an alloy selected from the group consisting of a bimetallic, trimetallic, tetrametallic and polymetallic, and wherein the alloy is selected from the group consisting of monofunctional, bifunctional, trifunctional, tetrafunctional, and polyfunctional.

Monofunctional nanoalloy combustion modifier compositions can be prepared from any combination of metals in group A as shown in the following non-limiting examples.

Bimetallics ($A_aA'_{a'}$): Mn/Fe, Mn/Co, Mn/Cu, Mn/Ca, Mn/Rh, Mn/Pd, Mn/Pt, Mn/Ru, Mn/Ce, Fe/Co, Fe/Cu, Fe/Ca, Fe/Rh, Fe/Pd, Fe/Rh, Fe/Pd/, Fe/Pt, Fe/Ru, Fe/Ce, Cu/Co, Cu/Ca, Cu/Rh, Cu/Pd, Cu/Pt, Cu/Ce, etc;

Trimetallics ($A_aA'_{a'}A''_{a}$): Mn/Fe/Co, Mn/Fe/Cu, Mn/Fe/Ca, etc; and

Polymetallics ($A_aA'_{a'}A''_{a''}A'''_{a'''}$ . . ., etc): Mn/Fe/Co/Cu/. . . etc, Mn/Ca/Rh/Pt/. . .etc, and so forth.

Similar monofunctional bimetallic and polymetallic nanoalloy compositions can be assembled for groups B, C, and D, respectively, to specifically address deposits (B), corrosion (C), and combustion co-modifier/electrostatic precipitator (D). Electrostatic precipitators (ESP) are installed in the flue gas after treatment systems of atmospheric pressure combustion systems (stationary burners) used in power utility furnaces/boilers, industrial furnaces/boilers, and waste incineration units. The ESP is a series of charged electrode plates in the flow path of combustion exhaust that electrostatically traps the fine particulate onto the plates so that they are not exhausted into the environment. Metals in group D above are known to enhance and maintain the optimum performance of the ESP in this task.

Polyfunctional alloy compositions can be formed between two or more different metal atoms across the functional groups A, B, C and D as shown in the following non-limiting examples:

Bifunctional (e.g., $A_a/B_b$, $A_a/C_c$, $A_a/D_d$, $B_b/C_c$, $B_b/D_d$, and $C_c/D_d$). Mn/Mg, Mn/Al, Mn/Cu, Mn/Mo, Mn/Ti, etc;

Trifunctional (e g., $A_a/B_b/C_c$, $A_a/C_c/D_d$, or $B_b/C_c/D_d$): Mn/Al/Mg, Fe/Mg/Cu, Cu/Si/Mg, etc., Tetrafunctional ($A_a/B_b/C_c/D_d$): Mn/Mo/Mg/Na, Fe/Al/Mg/Li, etc., Nanoalloys from combinations, such as $A_aB_b$, can also directly affect emissions Optimization of combustion and minimization of deposits in the combustion system/exhaust after-treatment system can lead to lower emissions of environmental pollutants.

Similar combinations can be prepared, for example, for $A_a/C_c$, $A_a/D_d$, $B_b/C_c$, $B_b/D_d$, and $C_c/D_d$, respectively, to address combustion/corrosion ($A_a/C_c$), combustion/combustion co-modifier and ESP ($A_a/D_d$), deposits/corrosion ($B_b/C_c$), deposits/combustion co-modifier and ESP ($B_b/D_d$), and corrosion/combustion co-modifier and ESP ($C_c/D_d$).

Methods for preparing the foregoing alloys are set forth in U.S. patent application Ser. No. 11/620,773, filed Jan. 8, 2007, incorporated herein by reference as if set forth in its entirety.

The alloys herein can be formulated into additives that can be in any form, including but not limited to, crystalline (powder), or liquids (aqueous solutions, hydrocarbon solutions, or emulsions) The liquids can possess the property of being transformable into water/hydrocarbon emulsions using suitable solvents and emulsifier/surfactant combination.

In an aspect, the alloys can be coated or otherwise treated with suitable hydrocarbon molecules that render them fuel soluble. The alloy can be coated to prevent agglomeration. For this purpose, the alloy can be comminuted in an organic solvent in the presence of a coating agent which is an organic acid, anhydride or ester or a Lewis base. It has been found that, in this way which involves coating in situ, it is possible to significantly improve the coating of the alloy. Further, the resulting product can, in many instances, be used directly without any intermediate step. Thus in some coating procedures it is necessary to dry the coated alloy before dispersing it in a hydrocarbon solvent.

The coating agent can suitably be an organic acid, anhydride or ester or a Lewis base. The coating agent can be, for example, an organic carboxylic acid or an anhydride, typically one possessing at least about 8 carbon atoms, for example about 10 to about 25 carbon atoms, for example from about 12 to 18 carbon atoms, such as stearic acid. It will be appreciated that the carbon chain can be saturated or unsaturated, for example ethylenically unsaturated as in oleic acid. Similar comments apply to the anhydrides which can be used. An exemplary anhydride is dodecylsuccinic anhydride. Other organic acids, anhydrides and esters which can be used in the process of the present disclosure include those derived from phosphoric acid and sulphonic acid. The esters are typically aliphatic esters, for example alkyl esters where both the acid and ester parts have from about 4 to about 18 carbon atoms.

Other coating or capping agents which can be used include Lewis bases which possess an aliphatic chain of at least about 8 carbon atoms including mercapto compounds, phosphines, phosphine oxides and amines as well as long chain ethers, diols, esters and aldehydes. Polymeric materials including dendrimers can also be used provided that they possess a hydrophobic chain of at least about 8 carbon atoms and one or more Lewis base groups, as well as mixtures of two or more such acids and/or Lewis bases.

Typical polar Lewis bases include trialkylphosphine oxides $P(R^3)_3O$, for example trioctylphosphine oxide (TOPO), trialkylphosphines, $P(R^3)_3$, amines $N(R^3)_2$, thiocompounds $S(R)_2$ and carboxylic acids or esters $R^3COOR_4$ and mixtures thereof, wherein each $R^3$, which may be identical or different, is selected from $C_{1-24}$ alkyl groups, $C_{2-24}$ alkenyl groups, alkoxy groups of formula —$O(C_{1-24}alkyl)$, aryl groups and heterocyclic groups, with the proviso that at least one group $R^3$ in each molecule is other than hydrogen; and wherein $R^4$ is selected from hydrogen and $C_{1-24}$ alkyl groups, for example hydrogen and $C_{1-14}$ alkyl groups. Typical examples of $C_{1-24}$ and $C_{1-4}$ alkyl groups, $C_{2-24}$ alkenyl groups, aryl groups and heterocyclic groups are described below It is also possible to use as the polar Lewis base a polymer, including dendrimers, containing an electron rich group such as a polymer containing one or more of the moieties $P(R^3)_3O$, $P(R^3)_3$, $N(R^3)_2$, $S(R^3)_2$ or $R^3COOR_4$ wherein $R^3$ and $R^4$ are as defined above; or a mixture of Lewis bases such as a mixture of two or more of the compounds or polymers mentioned above. When the additive is to be used in a combustor where the combustion byproducts attack and destroy the furnace refractory lining, then the nanoalloy capping or coating agent should be a phosphorus containing ligand. Examples of such ligands are included in the list above. The phosphorus containing combustion products coat the furnace refractory lining with a glass-like protective layer.

The coating process can be carried out in an organic solvent. For example, the solvent is non-polar and is also, for example, non-hydrophilic. It can be an aliphatic or an aromatic solvent Typical examples include toluene, xylene, petrol, diesel fuel as well as heavier fuel oils. Naturally, the organic solvent used should be selected so that it is compatible with the intended end use of the coated alloy. The presence of water should be avoided, the use of an anhydride as coating agent helps to eliminate any water present.

The coating process involves comminuting the alloy so as to prevent any agglomerates from forming. The technique employed should be chosen so that the alloys are adequately wetted by the coating agent and a degree of pressure or shear is desirable. Techniques which can be used for this purpose include high-speed stirring (e.g. at least 500 rpm) or tumbling, the use of a colloid mill, ultrasonics or ball milling. Typically, ball milling can be carried out in a pot where the larger the pot the larger the balls. By way of example, ceramic balls of 7 to 10 mm diameter are suitable when the milling takes place in a 1.25 liter pot. The time required will of course, be dependent on the nature of the alloy but, generally, at least 4 hours is required. Good results can generally be obtained after 24 hours so that the typical time is from about 12 to about 36 hours.

Also disclosed herein is a method of producing a fuel additive composition comprising treating the disclosed alloy with an organic compound; and solubilizing the treated alloy in a diluent. One of ordinary skill in the art would know the various diluents suitable for use in producing the fuel additive composition.

By "fuel" herein is meant hydrocarbonaceous fuels such as, but not limited to, diesel fuel, jet fuel, alcohols, ethers, kerosene, low sulfur fuels, synthetic fuels, such as Fischer-Tropsch fuels, liquid petroleum gas, bunker oils, gas to liquid (GTL) fuels, coal to liquid (CTL) fuels, biomass to liquid (BTL) fuels, high asphaltene fuels, petcoke, fuels derived from coal (natural and cleaned), genetically engineered biofuels and crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the fuels of the present disclosure include methanol, ethanol, isopropanol, t-butanol, mixed alcohols, methyl tertiary butyl ether, tertiary amyl methyl ether, ethyl tertiary butyl ether and mixed ethers. Oxygenates, when used, will normally be present in the reformulated gasoline fuel in an amount below about 25% by volume, and for example in an amount that provides an oxygen content in the overall fuel in the range of about 0.5 to about 5 percent by weight. "Hydrocarbonaceous fuel" or "fuel" herein shall also mean waste or used engine or motor oils which may or may not contain molybdenum, gasoline, bunker fuel, coal (dust or slurry), crude oil, refinery "bottoms" and by-products, crude oil extracts, hazardous wastes, yard trimmings and waste, wood chips and saw dust, agricultural waste, fodder, silage, plastics and other organic waste and/or by-products, and mixtures thereof and emulsions, suspensions, and dispersions thereof in water, alcohol, or other carrier fluids. By "diesel fuel" herein is meant one or more fuels selected from the group consisting of diesel fuel, biodiesel, biodiesel-derived fuel, synthetic diesel and mixtures thereof. In an aspect, the hydrocarbonaceous fuel is substantially sulfur-free, by which is meant a sulfur content not to exceed on average about 30 ppm of the fuel.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A process for improving the operation of combustors comprising the steps of:

burning a carbonaceous fuel in a combustion system;

determining combustion conditions within the combustor system that can benefit from a targeted treatment additive, wherein the determinations are made by calculation including computational fluid dynamics and observation;

locating introduction points in the combustor system where introduction of the targeted treatment additive could be accomplished;

based on the previous steps, providing a treatment regimen for introducing the targeted treatment additive to locations within the combustor system resulting in one or more benefits selected from the group consisting of reducing the opacity of plume, improving combustion, reducing slag, reducing LOI carbon, reducing corrosion, and improving electrostatic precipitator performance; and wherein the targeted treatment additive comprises an alloy represented by the following alloy represented by the following generic formula $(A_a)_n(B_b)_n(C_c)_n(D_{dn}(\ldots)_n$;

wherein each capital letter and (. . .) is a metal;

wherein A is a combustion modifier: B is a deposit modifier; C is a corrosion inhibitor; and D is a combustion co-modifier/electrostatic precipitator enhancer;

wherein each subscript letter represents compositional stoichiometry;

wherein n is greater than or equal to zero; and wherein the alloy comprises at least two different metals; and with the proviso that if the metal is cerium, then its compositional stoichiometry is less than about 0.7.

2. The process described in claim 1, wherein the carbonaceous fuel comprises a combustion catalyst.

3. The process described in claim 1, wherein the carbonaceous fuel comprises the targeted treatment additive.

4. The process described in claim 1, wherein the combustor system comprises a furnace and the step of determining combustion conditions comprises determining combustion conditions within the furnace.

5. The process described in claim 4, wherein the targeted treatment additive is introduced in the furnace.

6. The process described in claim 4, wherein the targeted treatment additive is introduced into the combustor system after the furnace.

7. The process described in claim 1, wherein the metal is selected from the group consisting of metalloids , transition metals, and metal ions.

8. The process described in claim 1, wherein A is selected from the group consisting of Mn, Fe, Co, Cu, Ca, Rh, Pd, Pt, Ru, 1r, Ag, Au, and Ce.

9. The process described in claim 1, wherein B is selected from the group consisting of Mg, Al, Si, Sc, Ti, Zn, Sr, Y, Zr, Mo, In, Sn, Ba, La, Hf, Ta, W, Re, Yb, Lu, Cu and Ce.

10. The process described in claim 1, wherein C is selected from the group consisting of Mg, Ca, Sr, Ba, Mn, Cu, Zn, and Cr.

11. The process described in claim 1, wherein D is selected from the group consisting of Li, Na, K, Rb, Cs, and Mn.

12. The process described in claim 1, further comprising wherein A, B and/or D is an emissions modifier.

13. The process described in claim 1, wherein the alloy is a nanoalloy comprising an average particle size of from about 1 to about 100 nanometers.

14. The process described in claim 1, wherein the alloy is a nanoalloy comprising an average particle size of from about 5 to about 75 nanometers.

15. The process described in claim 1, wherein the alloy is bimetallic.

16. The process described in claim 1, wherein the alloy is trimetallic.

17. The process described in claim 1, wherein the alloy is tetrametallic.

18. The process described in claim 1, wherein the alloy is polymetallic.

19. The process described in claim 1, wherein the alloy is monofunctional.

20. The process described in claim 1, wherein the alloy is bifunctional.

21. The process described in claim 1, wherein the alloy is trifunctional.

22. The process described in claim 1, wherein the alloy is tetrafunctional.

23. The process described in claim 1, wherein the alloy is polyfunctional.

24. The process described in claim 1 wherein the alloy is selected from the group consisting of bimetallic, trimetallic, tetrametallic, and polymetallic; and wherein the alloy is selected from the group consisting of monofunctional, bifunctional, trifunctional, tetrafunctional, and polyfunctional.

25. The process described in claim 1 wherein the alloy is treated with an organic compound.

26. The process described in claim 25, wherein the organic compound is selected from the group consisting of an organic carboxylic acid, organic anhydride, organic ester, and a Lewis base.

27. The process described in claim 26, wherein the organic carboxylic acid and organic anhydride comprise at least about 8 carbon atoms.

28. The process described in claim 26, wherein the organic ester is an aliphatic ester.

29. The process described in claim 26, wherein the Lewis base comprises an aliphatic chain comprising at least 8 carbon atoms.

30. The process described in claim 26, wherein the Lewis base is a phosphorus containing ligand.

* * * * *